US005161438A

United States Patent [19]

Pietras

[11] Patent Number: 5,161,438

[45] Date of Patent: Nov. 10, 1992

[54] POWER TONG

[75] Inventor: Bernd-Georg Pietras, Wedemark, Fed. Rep. of Germany

[73] Assignee: Weatherford/Lamb, Inc., Houston, Tex.

[21] Appl. No.: 805,014

[22] Filed: Dec. 11, 1991

[30] Foreign Application Priority Data

Apr. 12, 1991 [GB] United Kingdom ..... 9107788

[51] Int. Cl.[5] ..... B25B 17/00

[52] U.S. Cl. ..... 81/57.16; 81/57.34

[58] Field of Search ..... 81/57.15, 57.16, 57.18–57.22, 81/57.33, 57.34

[56] References Cited

U.S. PATENT DOCUMENTS 2,453,369 11/1948 Grable et al. .
3,021,739 2/1962 Grundmann .
3,371,562 3/1968 Kelley .
3,589,742 6/1971 Flick .
4,082,017 4/1978 Eckel .
4,092,881 6/1978 Jurgens et al. .
4,280,397 7/1981 Peveto .
4,836,064 6/1989 Slator .
5,081,888 1/1992 Schulze-Beck .

OTHER PUBLICATIONS

1990–91 General Services and Products Catalog Weatherford, 1989.

*Primary Examiner*—James G. Smith
*Attorney, Agent, or Firm*—Guy McClung

[57] ABSTRACT

A power tong for tightening and untightening tubular joints; and a buckling unit with such a tong.

13 Claims, 3 Drawing Sheets

POWER TONG

BACKGROUND OF THE INVENTION

1. Field of the Invention

This invention relates to power tongs and, in one aspect, to power tongs for releasing tight joints and to a bucking unit including such tongs.

2. Description of Related Art

Tongs are used for connecting and disconnecting threaded members. Generally, they are used in pairs, one tong (known as a "back-up tong") holding one length of pipe fast and the other tong (referred to herein as a "power tong") rotating a second length of pipe with respect to the first.

Typical power tongs have a rotary with pipe gripping jaws that is rotatably mounted in a housing and is driven in rotation by a gear train powered by an hydraulic motor. The hydraulic motor is usually capable of tightening joints to the required torque, but problems can arise when trying to separate pipes, for example, the pipes of a drill string that has been withdrawn from a bore.

SUMMARY OF THE PRESENT INVENTION

According to the present invention, there is provided in one embodiment a power tong for releasing tight joints, the tong having a housing and a rotary rotatably mounted therein, the rotary having a rotational axis, apparatus for inhibiting relative rotation between the rotary and the housing and apparatus for pivoting the housing with respect to the rotational axis of the rotary. Conveniently, in one embodiment, the apparatus for inhibiting relative rotation between the rotary and the housing comprises a bolt. If desired, at least two bolts may be provided. The bolt (or bolts) may enter the rotary through an upper and/or lower surface thereof and/or through a radial extremity thereof. Alternatively, the bolt (or bolts) may be arranged to project between adjacent teeth on the circumference of the rotary. The bolts may be moved either manually or automatically from a location remote from the tong.

The apparatus for pivoting the housing may be, in one embodiment, a long bar which can be placed in a slot in the housing. In one preferred embodiment, the apparatus is a pair of cylinders connected to opposite sides of the housing and actuable by pneumatic, or preferably hydraulic, fluid to pivot the housing. The cylinders are preferably double acting cylinders so that the power tong can untighten threads clockwise and anticlockwise and can also be used for applying very high tightening torques which may be required, for example for testing purposes. For this latter purpose, a load cell may be provided from which the torque applied to the joint can be determined.

In another preferred embodiment, the double acting piston and cylinders have an hydraulic section and a mechanical section, and the hydraulic section has a piston connected to an end fitting and disposed in a cylinder between two ports for permitting hydraulic fluid to flow to and from the cylinder, and the mechanical section has a piston disposed in the cylinder and connected to an opposite end fitting, the mechanical section separated from the hydraulic section by a wall. Preferably, the power tong includes cup springs disposed to either side of the piston in the mechanical section.

The present invention also provides a bucking unit having a back-up tong and a power tong in accordance with the invention.

It is, therefore, an object of the present invention to provide new, useful, unique, efficient and effective devices and methods for tightening and untightening tubular members.

Another object of the present invention is the provision of such devices and methods useful as tongs.

Yet another object of the present invention is the provision of such tongs which are useful for untightening very tight joints.

Yet another object of the present invention is the provision of a bucking unit employing tongs according to this invention.

The present invention recognizes and addresses the previously-mentioned long-felt needs and provides a satisfactory meeting of those needs in its various possible embodiments. To one of skill in this art who has the benefits of this invention's teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

Filed on even date herewith are two applications co-assigned with the present invention, one entitled Rotary For a Power Tong and one entitled Power Tong, copies of which are submitted herewith and fully incorporated herein.

DESCRIPTION OF THE DRAWINGS

So that the manner in which the above-recited features, advantages and objects of the invention, as well as others which will become clear, are attained and can be understood in detail, more particular description of the invention briefly summarized above may be had by reference to certain embodiments thereof which are illustrated in the appended drawings, which drawings form a part of this specification. It is to be noted, however, that the appended drawings illustrate preferred embodiments of the invention and are therefore not to be considered limiting of its scope, for the invention may admit to other equally effective equivalent embodiments.

For a better understanding of the invention, reference will now be made, by way of example, to the accompanying drawings, in which.

DESCRIPTION OF EMBODIMENTS PREFERRED AT THE TIME OF FILING FOR THIS PATENT

Figure 1:
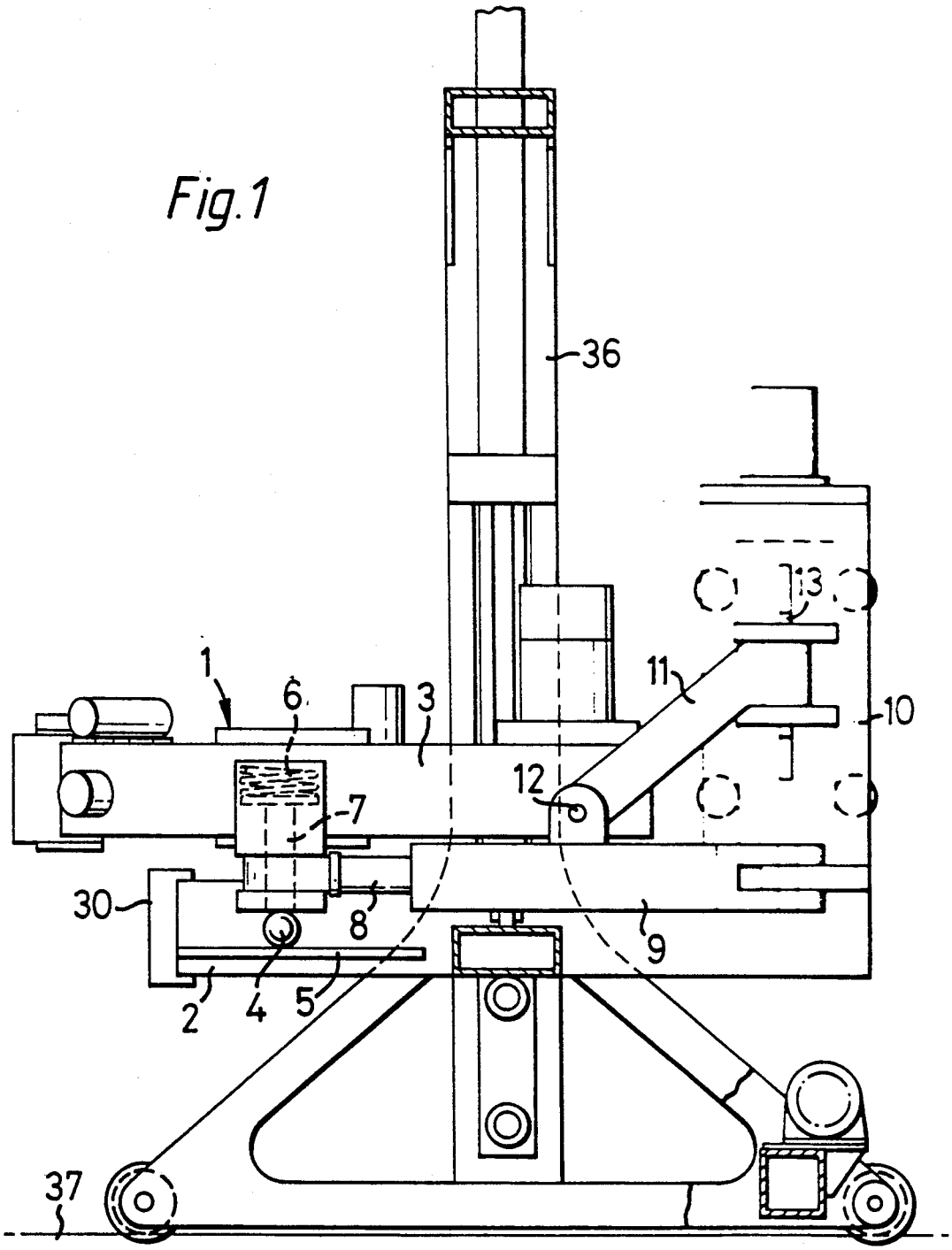
FIG. 1 is a side view of a bucking unit in accordance with the invention, supported in a travelling frame which is shown in cross-section.

Referring to the drawings, a bucking unit which is generally identified by reference numeral 1 has a back-up tong 2, and a power tong 3 disposed above the back-up tong 2.

The power tong 3 is supported on three balls, one of which 4, is shown in FIG. 1. The ball 4 rests on a flange 5 on the side of the back-up tong 2 and is biased downwardly by a spring 6 which acts on the ball 4 through a pin 7. The power tong 3 can move upwardly away from the back-up tong 2 during an unscrewing operation.

The piston 8 of a double acting hydraulic piston and cylinder assembly is pivotally mounted on pin 7. The cylinder 9 is pivotally mounted on a support member 10 projecting upwardly from the back-up tong 2. The cylinder 9 is also supported by an arm 11 which is pivotally mounted to the cylinder 9 at pivot 12 and to support member 10 about pivot 13.

Figure 2:
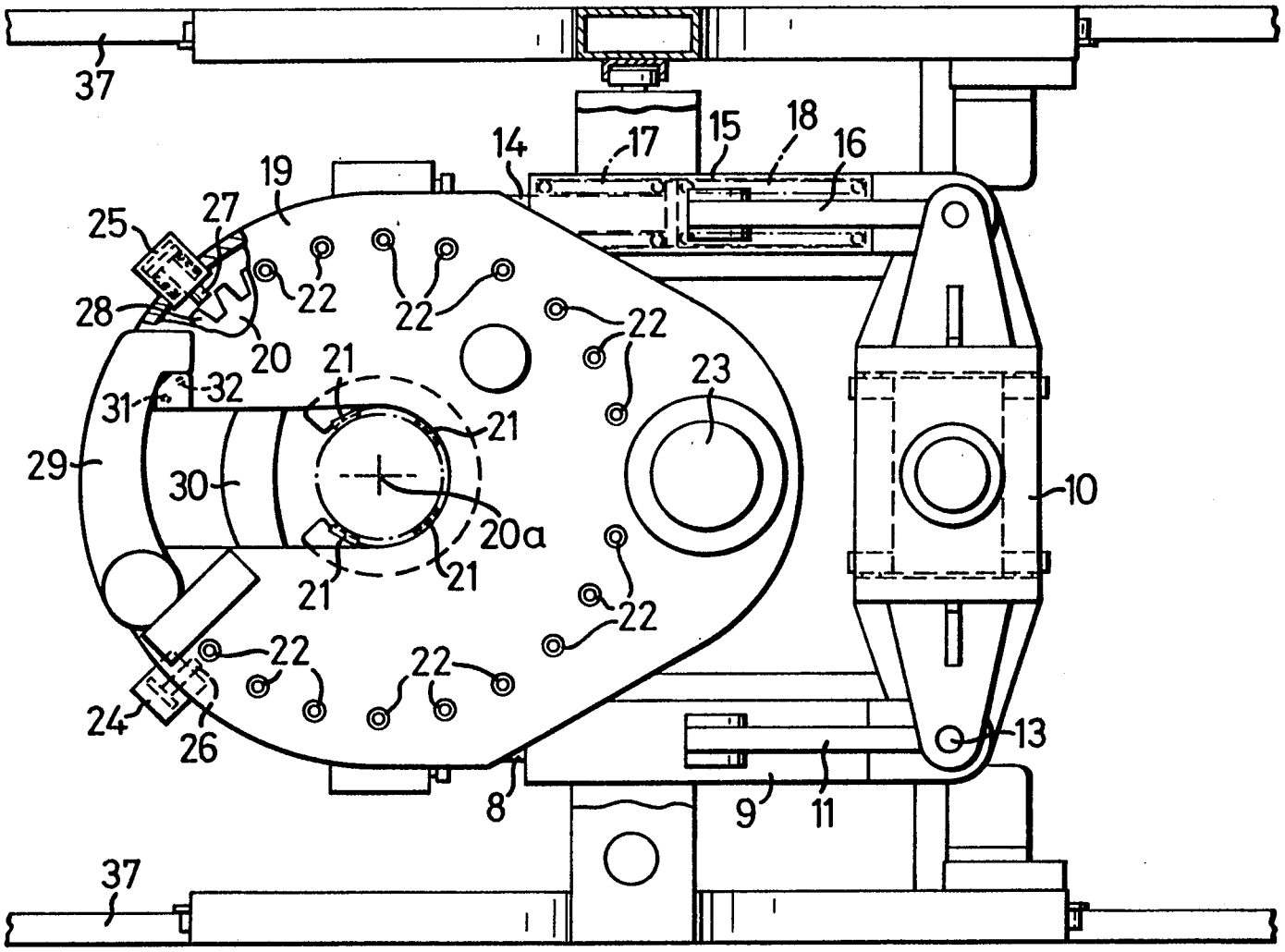
FIG. 2 is a top plan view of the bucking unit, with part broken away.

As can be seen from FIG. 2, the opposite side of the power tong 3 is provided with a piston and cylinder assembly which is similar to the arrangement hereinbefore described. In particular, a piston 14 is connected to a pin (not shown) associated with a spring and ball similar to spring 6 and ball 4. The piston 14 enters the cylinder 15 of a double acting piston and cylinder assembly which is pivotally mounted on support member 10 and supported by an arm 16 similar to arm 11.

It will be appreciated that the arrangement disclosed allows the power tong 3 to move in three orthogonal dimensions, e.g. along the x, y and z axis. In normal use, the cylinders 9 and 15 will be open to atmosphere and springs 17 and 18 are preferably provided to bias the power tong 3 towards its normal operating position.

The power tong 3 has a housing 19 which houses a rotary 20 which has an axis of rotation through the point 20*a* and is rotatably mounted in the housing 19. The rotary 20 is provided with jaws 21 which can be moved radially towards the center of the power tong 3. The rotary 20 is guided by a plurality of rollers which are mounted on axles 22 disposed circumjacent the center of the power tong 3. The rotary 20 is connected by a gear train (not shown) to an hydraulic motor 23.

Two actuators 24 and 25 are mounted on the housing 19 and can be actuated to thrust bolts 27 between the drive teeth 28 provided around the circumference of the rotary 20.

The bucking unit 1 is supported in a travelling frame 36 which runs on rails 37. Rotational axes of the two tongs are substantially coincident.

In use, when it is desired to disconnect a joint, the doors 29 and 30 on the power tong 3 and the back-up tong 2 respectively are opened. The travelling frame 36 is then advanced towards the pipe until the pipe enters the power tong 3 and the back-up tong 2. The doors 29 and 30 are then closed and the pipes gripped by the jaws in the respective tongs 2, 3. The hydraulic motor 23 is then actuated. Normally, this will be sufficient to unscrew the joint. However, situations do arise where the joint will not separate and the hydraulic fluid intended for the hydraulic motor 23 is returned to the reservoir via a safety valve.

When this situation arises, the hydraulic motor 23 is deactivated and actuators 24 and 25 are activated to advance plungers 26 until the bolts 27 are disposed between the teeth 28. At this stage, hydraulic fluid is admitted to the cylinders 9 and 15 to push the piston 14 to the left as shown in FIG. 2 and piston 8 to the right. The force tends to rotate the power tong 3 anti-clockwise. Since the bolts 27 hold the rotary 20 fast with the housing 19, the torque is applied to the rotary 20 and thence to the pipe (not shown) via the jaws 21. The cross-sectional area of the cylinders 9 and 15 is such that a substantial torque can be applied to the housing 19 to loosen even the most stubborn joints.

It will be appreciated that the bolts 27 should preferably project fully into the space between the teeth. This can be assured in several ways, for example, inspection ports can be provided in the housing 19 immediately above the free ends of the bolts 27. However, sensors 31, 32 are preferably provided which detect the position of the rotary 20 and prevent operation of the actuators 24 and 25 until position marks on the rotary 20 are aligned with the sensors 31, 32. As a further precaution, a position sensor (not shown) is also associated with each bolt 27 and inhibits actuation of the piston and cylinders until the bolts 27 are fully advanced.

Once the joint is loosened, the bolts 27 can be withdrawn and the joint unscrewed using the hydraulic motor 23 rotating rotary 20 in the usual way. Cylinders 9 and 15 are also vented to atmosphere to allow the power tong 3 to float in the horizontal plane.

Various modifications to the arrangement disclosed are within the scope of this invention. For example, the bolts 27 can be lowered through aligned holes in the top and bottom of the housing 19 and in the rotary 20.

Figure 3:
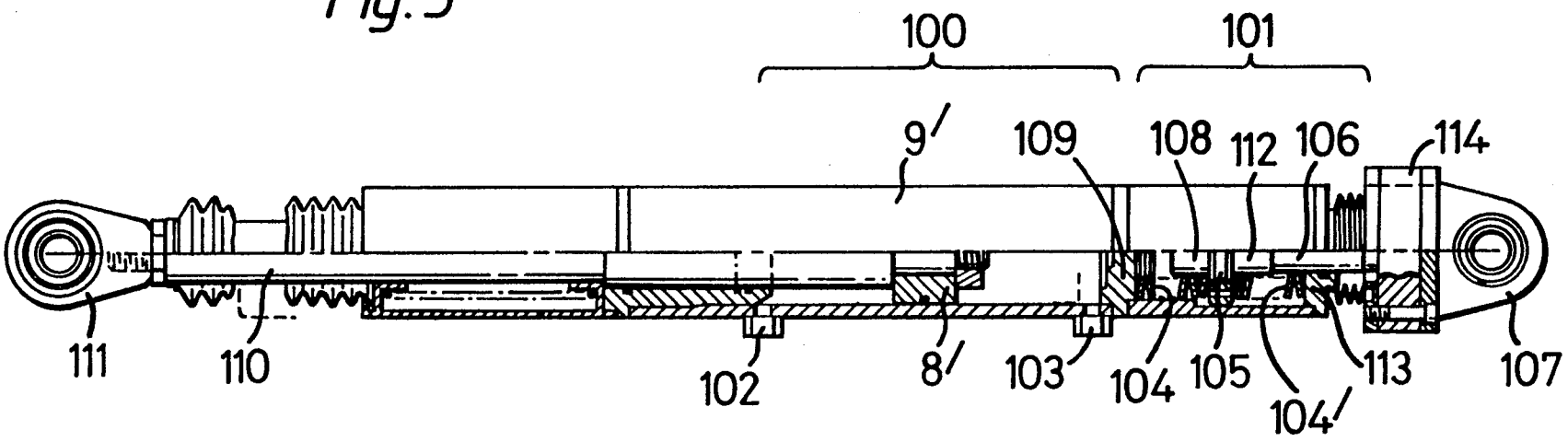
FIG. 3 is a partially sectioned side view of an alternative double acting hydraulic piston and cylinder assembly.

FIG. 3 shows an alternative double acting hydraulic piston and cylinder assembly. The assembly comprises a piston 8′ which is mounted in a cylinder 9′. The cylinder 9′ is divided into a hydraulic section 100 and a mechanical section 101. The hydraulic section 100 is provided with ports 102, 103 for the admission and discharge of hydraulic fluid and the mechanical section 101 has cup springs 104, 104′ disposed to either side of a piston 105 having a shaft 106 fast with an end fitting 107. The piston 106 has a short extension 108 which can engage a wall 109 separating the hydraulic section 100 from the mechanical section 101. The piston 8′ is connected to a shaft 110 which is secured to an end fitting 111.

In use, end fitting 111 is pivotally connected to the power tong 3 while the other end fitting 107 is pivotally connected to support member 10. A similar double acting piston and cylinder assembly is used on the opposite side of the power tong 3.

In normal operation, the hydraulic section 100 is kept full of hydraulic fluid. However, the passage of hydraulic fluid through ports 102 and 103 is prevented so that the piston 8′ is effectively locked with respect to the cylinder 9′. However, the arrangement in the mechanical section 101 allows the power tong 3 to float in the horizontal plane.

When it is desired to use the hydraulic section 100 to turn the power tong 3, hydraulic fluid is admitted to the cylinder 9′ through, for example, port 103 and a corresponding volume of hydraulic fluid is exhausted through port 102. Thrust is applied to the power tong 3 via end the fitting 111 and the reaction force urges the cylinder 9′ to the right (as viewed in FIG. 3) until the short extension 108 abuts the wall 109 whereafter the thrust is transmitted through piston 106 to end fitting 107.

The situation in the opposite double acting hydraulic piston and cylinder assembly complements the turning action. In particular, hydraulic fluid is admitted through port 102 and exhausted through port 103. The hydraulic fluid causes the cylinder 9′ to move towards end fitting 111 until the hand 112 bears on the end wall 113 of the cylinder 9′ via cup springs 104′. At this time, end fitting 111 moves towards end fitting 107.

The two double acting hydraulic piston and cylinder assemblies produce a turning couple on the power tong 3.

At the end of a joining/unjoining operation, the pressure at ports 102, 103 is allowed to equalize and further passage of hydraulic fluid through the ports 102, 103 is prevented by closing valves (not shown). The double acting hydraulic piston and cylinder assemblies are then in their normal position as shown in FIG. 3 in which the hydraulic section 100 is effectively locked solid and the mechanical sections 101 of each assembly allows the power tong 3 to float in a generally horizontal plane.

A load cell 114 is incorporated in each assembly 114 adjacent end fitting 107 to check that the assemblies are in balance during a coupling/uncoupling operation.

In conclusion, therefore, it is seen that the present invention and the embodiments disclosed herein are well adapted to carry out the objectives and obtain the ends set forth at the outset. Certain changes can be made in the method and apparatus without departing from the spirit and the scope of this invention. It is realized that changes are possible and it is further intended that each element or step recited in any of the following claims is to be understood as referring to all equivalent elements or steps for accomplishing substantially the same results in substantially the same or equivalent manner. It is intended to cover the invention broadly in whatever form its principles may be utilized. The present invention is, therefore, well adapted to carry out the objects and obtain the ends and advantages mentioned, as well as others inherent therein.

What is claimed is:

1. A power tong for releasing joints, the power tong comprising a housing and a rotary rotatably mounted therein, the rotary having a rotational axis, means to inhibit relative rotation between the rotary and the housing, and means to pivot the housing about the rotational axis of the rotary with respect to the joints.

2. The power tong of claim 1, wherein the means for inhibiting relative rotation between the rotary and the housing comprises at least one bolt.

3. The power tong of claim 2, wherein the at least one bolt is two bolts.

4. The power tong of claim 2, wherein at least part of a circumference of the rotary is provided with teeth and the at least one bolt is movable between the teeth.

5. The power tong of claim 2, wherein the at least one bolt is disposable through aligned openings in the housing and in the rotary.

6. The power tong of claim 1, wherein the means for pivoting the housing comprises a pair of pistons and cylinders connected to opposite sides of the housing.

7. The power tong of claim 6, wherein the piston and cylinders are double acting pistons and cylinders.

8. The power tong of claim 7, wherein the double acting piston and cylinders comprise an hydraulic section and a mechanical section, and wherein the hydraulic section comprises a piston connected to an end fitting and disposed in a cylinder between two ports for permitting hydraulic fluid to flow to and from the cylinder, and wherein the mechanical section comprises a piston disposed in the cylinder and connected to an opposite end fitting, the mechanical section separated from the hydraulic section by a wall.

9. The power tong of claim 8, including cup springs disposed to either side of the piston in the mechanical section.

10. The power tong as claimed of claim 1 wherein the means to pivot the housing is provided with a load cell.

11. A power tong for releasing joints, the power therein, a housing and a rotary rotatably mounted tong comprising at least two bolts to inhibit relative rotation between the rotary and the housing, a pair of double-acting pistons and cylinders connected to opposite sides of the housing to pivot the housing with respect to the joints, part of a circumference of the rotary having teeth and the bolts movable between the teeth and, disposable through aligned openings in the housing and in the rotary, the double acting piston and cylinders comprising an hydraulic section and a mechanical section, the hydraulic section comprising a piston connected to an end fitting and disposed in a cylinder between two ports for permitting hydraulic fluid to flow to and from the cylinder, the mechanical section comprising a piston disposed in the cylinder and connected to an opposite end fitting, the mechanical section separated from the hydraulic section by a wall, and cup springs disposed to either side of the piston in the mechanical section.

12. A bucking unit comprising a frame, a back-up tong connected to the frame, and a power tong connected to the frame and spaced apart from the back-up tong, the axes of the two tongs coinciding and the power tong comprising a housing and a rotary rotatably mounted therein, means to inhibit relative rotation between the rotary and the housing, and means to pivot the housing with respect to the joints.

13. A bucking unit comprising a frame, a back-up tong connected to the frame, and a power tong connected to the frame and spaced apart from the back-up tong, the axes of the two tongs coinciding and the power tong comprising a housing and a rotary rotatably mounted therein, at least two bolts to inhibit relative rotation between the rotary and the housing, a pair of double-acting pistons and cylinders connected to opposite sides of the housing to pivot the housing with respect to the joints, part of a circumference of the rotary having teeth and the bolts movable between the teeth and, disposable through aligned openings in the housing and in the rotary, the double acting pistons and cylinders comprising an hydraulic section and a mechanical section, the hydraulic section comprising a piston connected to an end fitting and disposed in a cylinder between two ports for permitting hydraulic fluid to flow to and from the cylinder, the mechanical section comprising a piston disposed in the cylinder and connected to an opposite end fitting, the mechanical section separated from the hydraulic section by a wall, and cup springs disposed to either side of the piston in the mechanical section.

* * * * *